US007744496B2

(12) United States Patent
Chisena

(10) Patent No.: US 7,744,496 B2
(45) Date of Patent: Jun. 29, 2010

(54) BATTING PRACTICE TEE

(76) Inventor: Michael P. Chisena, P.O. Box 7619, Garden City, NY (US) 11530

( * ) Notice: Subject to any disclaimer, the term of this patent is extended or adjusted under 35 U.S.C. 154(b) by 345 days.

(21) Appl. No.: 11/709,563

(22) Filed: Feb. 22, 2007

(65) Prior Publication Data

US 2008/0207358 A1 Aug. 28, 2008

(51) Int. Cl.
*A63B 69/00* (2006.01)

(52) U.S. Cl. ..... 473/417; 473/422; 473/451

(58) Field of Classification Search ..... 473/417, 473/422, 431, 451

See application file for complete search history.

(56) References Cited

U.S. PATENT DOCUMENTS

| | | | | |
|---|---|---|---|---|
| 3,489,411 | A | 1/1970 | Morelli | |
| 4,664,374 | A | 5/1987 | Groves | |
| 4,709,924 | A | 12/1987 | Wilson et al. | |
| 4,962,924 | A | 10/1990 | James | |
| 5,004,234 | A | 4/1991 | Hollis | |
| 5,388,823 | A | 2/1995 | Prieto | |
| D373,806 | S | 9/1996 | Bunnell | |
| 5,556,091 | A | 9/1996 | Lin | |
| 5,916,045 | A | 6/1999 | Busch | |
| 6,099,418 | A * | 8/2000 | Owen | 473/417 |
| 6,238,307 | B1 | 5/2001 | Owen | |
| D479,290 | S * | 9/2003 | DeChenne | D21/717 |
| 6,979,273 | B2 | 12/2005 | Tsai | |
| 2005/0143196 | A1 * | 6/2005 | Tsai | 473/417 |

* cited by examiner

*Primary Examiner*—Mitra Aryanpour
(74) *Attorney, Agent, or Firm*—Hoffmann & Baron, LLP

(57) ABSTRACT

An improved multi-adjustable batting practice tee featuring a base assembly with an improved tube assembly thereby enhancing tube movement and overall batting tee stability is disclosed. The base assembly is configured to have standard dimensions for a "HOME PLATE" in accordance with the rules of Major League baseball. The base assembly includes a continuous channel positioned across the entire horizontal plane of the base assembly that includes an inner-locking guide rail system for enhanced batting tee stability.

31 Claims, 16 Drawing Sheets

BATTING PRACTICE TEE

FIELD OF THE INVENTION

The present invention generally relates to a batting practice tee, and more particularly to a multi-adjustable batting practice tee that is movable to various positions with respect to a home plate.

BACKGROUND OF THE INVENTION

Batting practice tees are well known in the art. Typically, the devices include an upright holder or tube assembly for holding a ball that is attached to a base assembly, such as a home plate. The tube assembly may have a telescopic construction that allows a user of the device to adjust the height of the ball, and thereby simulate high and low pitches and compensate for different sized batters or players.

Certain tees of the prior art can be rotated to a series of different positions on its base through a pin and hole system, as well as be placed in multi-position tee holes formed in the base. The performance of many prior art tees, however, is limited by the placement of the tube assembly on the base. For example, stationary tees restrict the ball to a single rotation over the center of the base. Many prior art rotating tees limit tee stem placement to a few locations over home plate. By restricting tee locations to particular positions on the base, the tee does not provide full coverage of the hitting area. Furthermore, current tees of the prior art generally do not allow for batters to hit balls in front of the base or areas extending along the sides of the base where optimal force can be applied.

Various batting practice tees are disclosed in the prior art. For example, U.S. Pat. No. 3,489,411 to Morelli et al., discloses a batting tee that uses a horizontal support member having a slot along its length. Morelli et al. attempt to provide additional tee adjustment by causing a slotted member to pivot about a single point anchored in the base. U.S. Pat. No. 4,709,924 to Wilson et al also disclose a slotted horizontal support member which is used in a manner similar to that of U.S. Pat. No. 3,489,411. However, instead of pivoting about an end point of the horizontal arm as disclosed in Morelli et al, Wilson et al. causes the horizontal arm to pivot about a central pivot point which is in the slot of the horizontal arm.

Some prior art patents have disclosed channels extending in different directions. For example, in U.S. Pat. No. 4,962,924 to James, a batting practice tee is disclosed that includes a base having an upper surface and a lower surface including a slot extending in a plurality of discrete directions over these surfaces. The "discrete directions" for these channels are designed to be separate and distinct pathway directions for the batting tee to be positioned to and are discontinuous from each other. As such, the channels disclosed in James have the disadvantage of not allowing the batting tee to be moved in a horizontal direction across the entire base. Furthermore, the batting tee is not capable of being moved throughout the top area of a standard home plate.

U.S. Pat. No. 5,004,234 to Hollis discloses a batting practice tee having two separate and distinct grooved slots in the base assembly. As explained in Hollis, these two slots are "spaced apart" and are used in conjunction with a horizontal support member having a pedestal at each end with a batter's pole to be positioned on the pedestal. The batter's pole does not appear to be itself positioned in the grooved track even though a track exists across the horizontal plane of the base assembly. Furthermore, as shown in the drawings of the patent, the Hollis batting tee does not permit the ball to be positioned at any desired location over the base assembly.

U.S. Pat. No. 6,238,307 to Owen discloses a batting practice tee having a grooved channel with an open slot in beveled edges of the base assembly. Owen further discloses two channels in the base assembly with the direction of each channel being different. The Owen's patent, however, uses a base member which is not a standardized—regulation size home plate. As explained in Owen, a forward extension of a traditional home plate is provided. As such, the "grooved-like" tracks of the Owen batting tee are designed to extend beyond the traditional "home plate" area, that is, into a forward extension area of the base. Disadvantageously, the batting tee of Owen is not movable in a horizontal plane across and through the surface of a standard home plate area, does not cover each position over the strike zone of the base assembly, and is not easily moved from one channel to another channel.

Further disadvantages of both the Owen and Hollis patents are discussed in abandoned U.S. patent application Ser. No. 10/784,640 to Tsai filed on Dec. 29, 2003. The Tsai application discloses a batting practice tee that includes a home plate having a top face in which a plurality of channels extending in different directions are embedded. The channels disclosed in the Tsai application are not continuous but overlap each other and do not allow the tee to be transferred from channel to channel within the tracking system.

Each of the foregoing prior art batting tees also suffers from a common disability in that only a slight pressure applied to the batting tee while hitting a ball can cause the horizontal arm to pivot and/or move, thereby creating an unwanted re-positioning of the tee. Furthermore, upon hitting a ball on the tee, the transmission of force can cause damage to the connection of the arm to the base and undesirably move the base from its support surface.

As such, what is needed is a multi-adjustable batting tee that is movable across the entire hitting area in the horizontal plane of a base assembly, without disengagement of the tube assembly from the base assembly, while simultaneously providing enhanced stability to minimize unwanted repositioning of the tee upon use.

SUMMARY OF THE INVENTION

An improved multi-adjustable batting practice tee featuring a base assembly with an improved tube assembly thereby enhancing tube movement and overall batting tee stability is disclosed. The base assembly is configured to have standard dimensions for a "HOME PLATE" in accordance with the rules of Major League baseball. The base assembly includes a continuous channel positioned across its entire horizontal plane incorporating an inner-locking guide rail system for enhanced tube movement and locking procedures thereby providing overall batting tee stability.

In one preferred embodiment, the tube assembly of the present invention comprises a telescopically interconnected first and second cylindrically shaped members that allow for height adjustment and includes a ball cradle at a top end. Upon insertion of the tube assembly through a beveled edge of the base, the tube assembly may be easily moved throughout the entire channel to any desired hitting location over the base assembly. Once the tube assembly is positioned at a desired hitting location, the assembly may be securely locked to the location using a one-hand rotational operation.

Various aspects of the batting practice tee relate to a base assembly and a tube assembly. For example, in one aspect, a batting practice tee includes a base assembly including a continuous channel fixedly mounted to said base assembly, said channel including an inner-locking guide rail positioned along a portion of a bottom surface of said channel, and a tube assembly for holding a ball, said tube assembly removably coupled to said channel and rotatable between an open position and a closed position, wherein, in said open position, said tube assembly is removable from said channel and movable throughout said channel, and wherein, in said closed position, said tube assembly engages said channel and its inner-locking guiderail to secure said tube assembly to a location along said channel, said tube assembly holding said ball above said location.

In some embodiments, one or more of the following advantages may be present. For example, the present invention permits all users of the device to practice swinging at a ball by adjusting an upper member of the tube assembly to a user selected height in conjunction with a strike zone and by uniquely creating a system allowing for the ease of movement of the entire tube assembly across and through the entire hitting zone over home plate. Furthermore, the user can select any hitting zone in that user's potential strike zone over home plate to lock the tube assembly into a secured position using a one-handed movement. Furthermore, the tube-assembly and channeling systems of the present invention allow the user to repetitively strike the ball on the cradle without the tube assembly or the base assembly unwarrantedly being repositioned.

Another advantage of the present invention relates to the ability of the device to improve a user's "hot zones" and "cold zones", which refer to a user's relative skills and success in hitting a pitched ball thrown to them over certain areas of home plate. The "hot zone" of a user is that area in the user's strike zone over home plate where the user has developed relative success in hitting the ball. The "cold zone" of a user is that area in the user's strike zone over home plate where the user has experienced difficulty in successfully hitting a pitched ball. The present invention allows each player to practice striking a ball on the base assembly whether intentionally placed in that particular user's "hot zones" to further develop prowess for balls pitched in that area over home plate or in the "cold zones" which requires repetitive practice to achieve success to become a better hitter relative to balls pitched in that area over home plate. As such, the present invention permits users of the device to selectively locate the tube assembly in any area over the strike zone of home plate so that the user can improve his/her batting skills as they desire.

Additional features and advantages will be readily apparent from the following detailed description, the accompanying drawings and the claims.

BRIEF DESCRIPTION OF THE DRAWINGS

Like reference symbols in the various drawings indicate like elements.

DETAIL DESCRIPTION OF THE PREFERRED EMBODIMENTS

Figure 1:
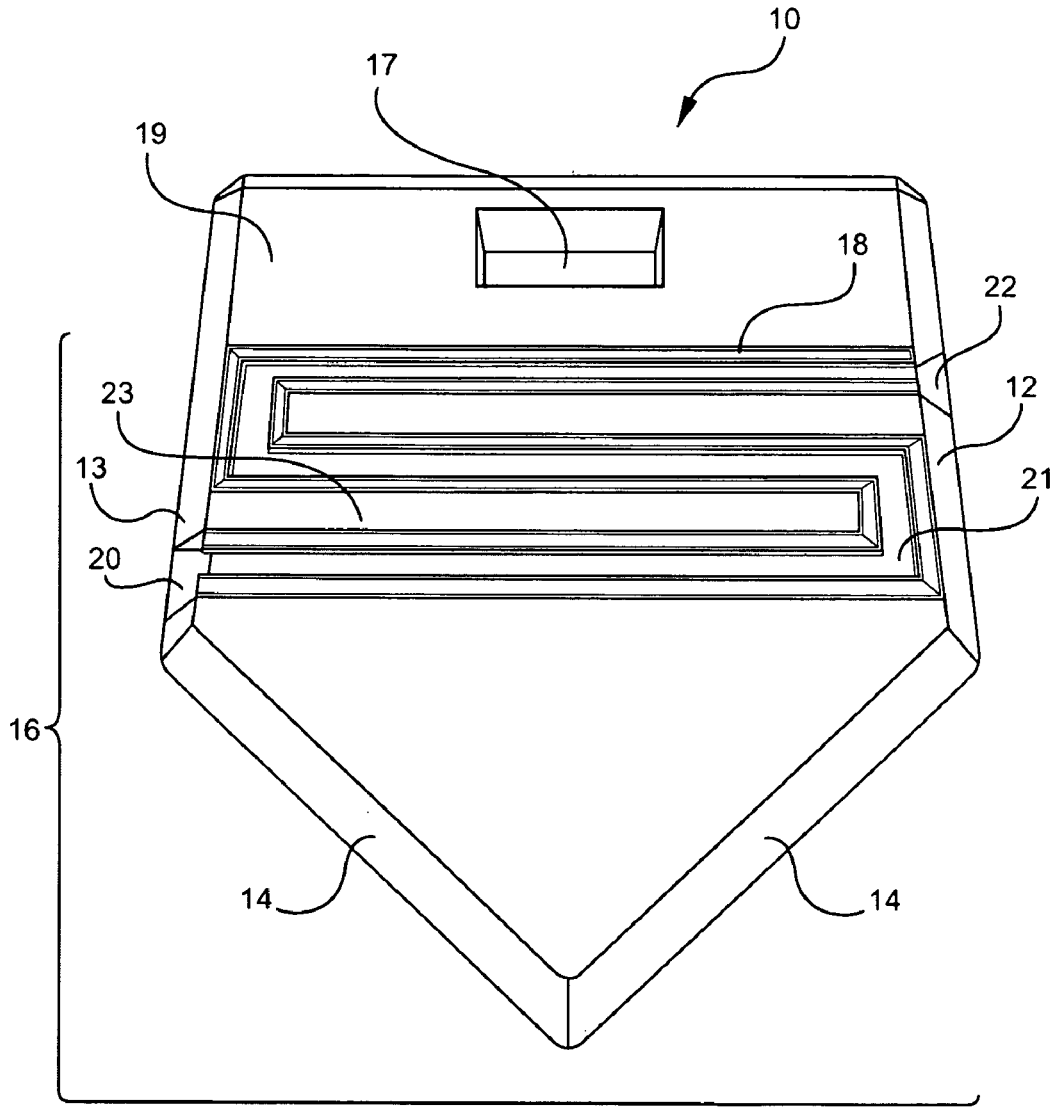
FIG. 1 is a front perspective view of a base assembly including a first channeling system according to the present invention.
Figure 2:
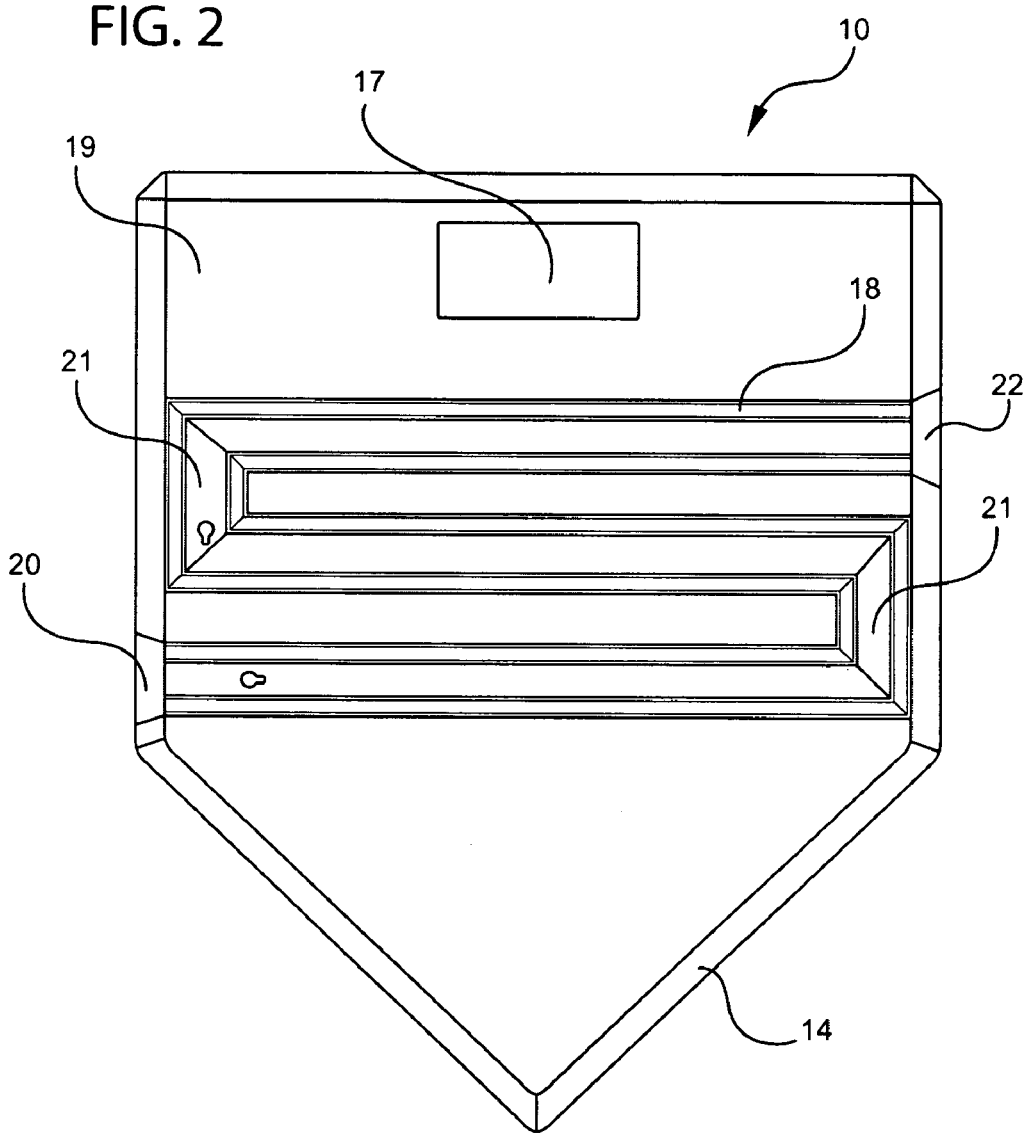
FIG. 2 is a top perspective view of the base assembly of FIG. 1.
Figure 3:
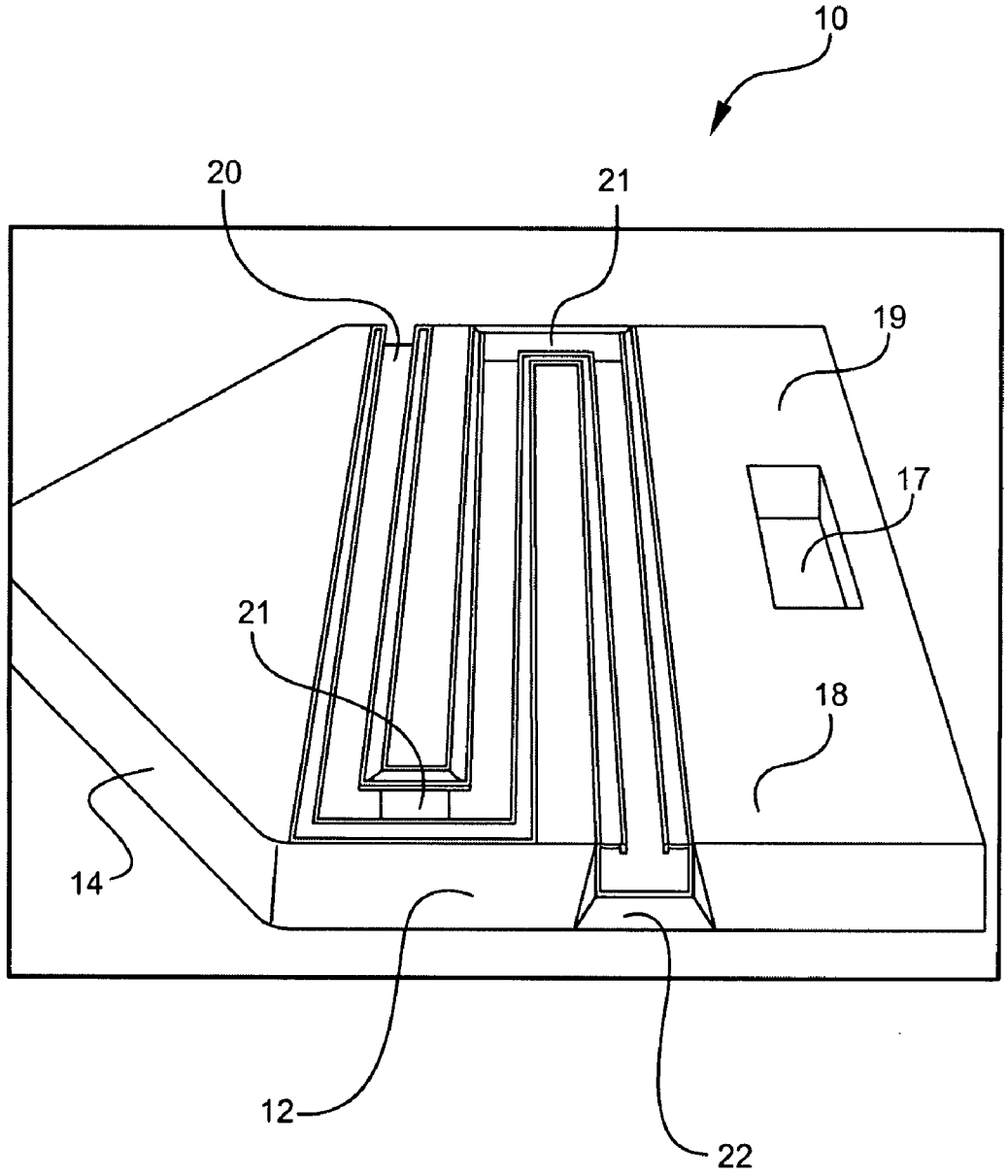
FIG. 3 is a side perspective view of the base assembly of FIG. 1.

Referring to FIGS. 1-3, in one preferred embodiment, a base assembly 10 for a batting practice tee according to the present invention is disclosed. As shown in FIGS. 1-3, the base assembly 10 includes a plate portion 16 defining a baseball strike zone having the design and dimensions of a Major League Baseball home plate. The design and dimensions of a Major League Baseball home plate are described in the rules of Major League Baseball, which are incorporated herein by reference.

Preferably, the base assembly 10 is constructed from a suitable rigid material, such as rubber or plastic, and is portable. In one preferred embodiment, for example, the base assembly 10 includes a leading edge 18, a V-shaped trailing edge 14, and parallel side edges 12, 13 extending between said leading 18 and trailing 14 edges, respectively. Preferably, the edges 12, 13, 18, 14 of the base assembly 10 are upward sloping and extend from a bottom surface of the assembly 10 towards an upper surface 23 of the assembly 10.

Optionally, as shown in FIGS. 1-3, the base assembly 10 also may include a handle formed from an optional forward portion 19 and opening 17 in the base assembly 10. Of course, it will be appreciated by one skilled in the art that the present invention is not limited to the type of handle depicted in FIGS. 1-3 and that various other types of handles may be attached to the same or different portions of the base assembly 10.

Preferably, the base assembly 10 is formed having a depth capable of supporting a channeling system. The channeling systems of the present invention each include a continuous channel that provides overall stability for a tube assembly 50 (described in connection with FIGS. 7-10) and the base assembly 10. In one preferred embodiment, as shown in FIGS. 1-4, a first channeling system may be grooved into the top surface 23 of the assembly 10 and includes a continuous channel 21 having a generally inverted T-shape. The channel 21 may be adhered to the base assembly 10 using conventional attachment means such as glue, screws 27 and fasteners. Of course, it will be appreciated by one skilled in the art that other types of attachment means may be used to secure the channel 21 to the base assembly 10.

In another preferred embodiment, the first channeling system is attached to the top surface 23 of the base assembly 10. In yet other preferred embodiments, the first channeling system and base assembly 10 are pre-fabricated as a single device with the first channeling system either grooved into the base or attached to the top surface of the base assembly 10.

Referring now to FIGS. 1-3 and 11-12, in one preferred embodiment, the channel 21 of the present invention includes one or more entry/egress locations 20, 22 that are positioned between the two parallel sides 12, 13 of the base assembly 10. In one preferred embodiment, the channel 21 extends in a first direction across the entire horizontal plane of the base assembly 10 beginning from an edge on one of the parallel sides 12, 13 to a corresponding edge on the opposite parallel side of the base assembly 10, hereinafter referred to as a precision hitting zone.

In one preferred embodiment, the channel 21 provides at least two precision hitting zones that are grooved into the base assembly 10. It will be appreciated by one skilled in the art that the channel 21 provides a plurality of precision hitting zones between the leading edge 18 and the parallel side edges 12, 13 of the base assembly 10 which is the aforementioned area of the defined strike zone over the home plate portion 16.

Regardless of the number of precision hitting zones provided, the present invention provides an apparatus and technique for directly communicating the tube assembly 50 (as described in connection with FIGS. 7-10) from one precision hitting zone to any other precision hitting zone as a result of the present invention's channeling system. Furthermore, at no time during this communication from one hitting zone to another is there any need for the tube assembly 50 to be removed from any of the channeling systems disclosed herein.

For example, in one preferred embodiment, as shown in the figures, the channel 21 includes an entry point on either of the two parallel side edges 12, 13 of the base assembly 10 and extends in a first direction across the entire horizontal plane of the base assembly 10 to form a first precision hitting zone. The channel 21 is formed to uninterruptedly continue in a first rearward direction towards the V-shaped trailing edge 14 of the base assembly 10 and then along a second direction across the horizontal plane of the base assembly 10 extending from the parallel side of the base assembly 10 where the first direction terminated to a corresponding edge on the opposite parallel side of the base assembly 10, hereinafter referred to as a second precision hitting zone. Preferably, the channel 21 at the termination point of the second precision hitting zone ends with an opening in the beveled edge of the parallel side of the base assembly 10 where the second precision hitting zone terminates with the fully equipped tube assembly 50 easily removable from the base assembly 10.

In another embodiment of the present invention, the channel 21 is adapted at the termination point of the second precision hitting zone to uninterruptedly continue in a second rearward direction towards the V-shaped trailing edge 14 of the base assembly 10 and then along a third direction across the horizontal plane of the base assembly 10 where the second direction terminated to a corresponding edge on the opposite parallel side of the base assembly 10, hereinafter referred to as a third precision hitting zone.

In yet another embodiment of the present invention, additional precision hitting zones are provided with the base assembly and the technique for communicating the tube assembly 50 from one precision hitting zone to another precision hitting zone within the channel 21 is as described previously, that is, from the first precision hitting zone to the second precision hitting zone as well as from the second precision hitting zone to the third precision hitting zone.

Figure 17:
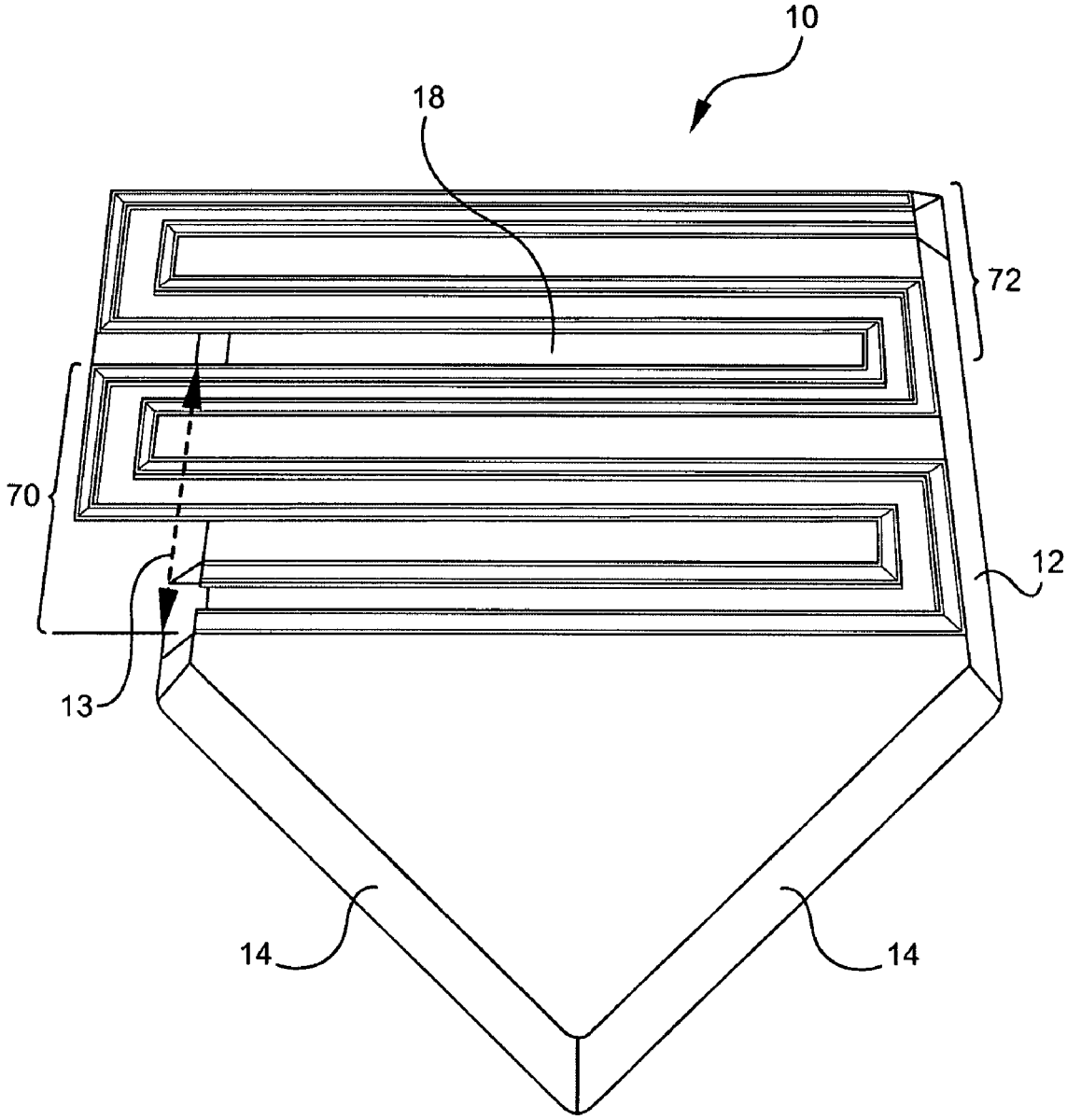
FIG. 17 is a top perspective view of side channel and front channel extensions according to the present invention.

For example, referring now to FIG. 17, in one preferred embodiment, a side-channel extension 70 and a forward channel extension 72 are provided with the base assembly 10. As shown in FIG. 17, the side-channel extension 70 allows the tube assembly 50 to be moved beyond the parallel side edge 13 of base assembly 10 and thus outside the official Major League Baseball defined strike zone without the tube assembly 50 being removed from the channeling system 21. As such, the length of a particular precision hitting zone across the horizontal plane of the base assembly 10 may be enlarged. Although only a left-side channel extension 70 is shown in FIG. 17, the present invention is not limited to solely one side extension. For example, in one preferred embodiment, left and right side-channel extensions may be provided with the base assembly 10.

Preferably, the side channel extension 70 is designed for the advanced and professional player who, as result of this status, possibly has mastered the correct hitting zones over home plate. Before a pitched ball reaches home plate, the skilled player may quickly differentiate a ball heading towards the strike zone over home plate from a ball pitched just beyond the inside or outside corners of home plate.

Preferably, the side channel extension 70 permits the player to practice coordination as to recognition of pitch location and may aid in the decision of whether to swing at a pitched ball that is coming at the player towards the inside corner of the plate or slightly beyond the outside corner of home plate.

Advantageously, the extensions provided by the present invention allow the player to practice directional hitting by striking the ball as it passes on a parallel plane beyond either or both two parallel side edges 12, 13 of home plate 16. Desirably, this feature allows a player to strike a pitched ball outside the normal confines of the standardized strike zone, in an attempt to consciously hit the ball to a certain part of the field. For example, using the above-described feature, a right-handed batter can practice hitting the ball down the right field line by reaching out over the plate and using a right-side channel extension (not shown in FIG. 17) and a left-handed batter can practice hitting the ball down the left field line by reaching out over the plate and using the left-side channel extension 70 (as shown in FIG. 17).

Preferably, the player is aware of the proper dimensions of home plate 16 and simultaneously is cognizant of moving the tube assembly 50 beyond the dimensions of the parallel side edges 12, 13 of home plate 16 into the extended practice hitting zone adjacent to the parallel side edges. The method of delineating the side channel extension areas from the conventional base plate 16 may be by any duly identifying manner such as by markings at the lower portion 29 of channel 21 along the two parallel side edges 12, 13 of the conventional base plate 16. Preferably, the channeling system does not extend into the area adjacent to either side of the V-shaped trailing edge 14 of the base assembly 10.

Similarly, a forward channel extension 72 may be provided with the base assembly 10. As shown in the FIG. 17 example, in one preferred embodiment, the forward channel extension 72 allows the tube assembly 50 to be moved from the channeling system 21 as described previously into a continuation of that channeling system extending above the leading edge 18 of base assembly 10 without having to remove the tube assembly 50 from the channeling system 21. In a preferred embodiment, the forward channel extension incorporates a single precision hitting zone as previously described and, in other preferred embodiments, as shown in FIG. 17, the forward channel extension incorporates a plurality of precision hitting zones. Furthermore, in one preferred embodiment, the forward channel extension terminates at parallel side edges 12, 13 as if extended above leading edge 18. In another preferred embodiment, as shown in FIG. 17, the forward channel extension 72 extends beyond one parallel side edge. In yet another preferred embodiment, the forward channel extension 72 extends beyond both parallel side edges 12, 13.

The technique for communicating the tube assembly 50 from the channeling system 21 as described in the present invention and, as depicted for example in FIGS. 1-3, 13A-G, into the forward channel extension is as described previously, that is, from one precision hitting zone to another precision hitting zone.

The technique for communicating the tube assembly 50 in any preferred embodiment containing at least one side channel extension, as previously described, into the forward channel extension, as depicted for example in FIG. 17 shall be as described previously, that is, from one precision hitting zone to another precision hitting zone.

The forward channel extension may be designed for the advanced and professional player who possesses adequate skills in deciphering the proper hitting zones over home plate. Such a player has exhibited prowess in recognizing a pitched ball in the strike zone over home plate as opposed to a ball pitched just beyond the inside or outside corners of home plate. Further, a player of this skill may also desire to practice striking the ball in front of the leading edge 18 of home plate 16.

The forward channel extension 72 of the present invention addresses the need for practice striking a pitched ball before it reaches the leading edge of home plate. This may allow the sophisticated player to practice directional hitting by striking the ball before it reaches home plate and thereby permit the player to intentionally direct his swing in order to hit a pitched ball into the right or left field corners of the playing field or to swing at a curveball before the ball breaks over the plate or a splitter before it radically sinks out of the strike zone.

The method of delineating the forward channel extension 72 from the leading edge 18 of the base assembly 10 may be by any duly identifying manner such as by appropriate markings within the forward channel extension area itself and, in other preferred embodiments, by any duly identifying manner such as by markings at the lower portion 29 of that portion of channel 21 of base assembly 10 which is adjacent to leading edge 18 forming part of the forward channel extension.

Of course, it will be appreciated by one skilled in the art that some embodiments of the present invention may include one or two side channel extensions and other embodiments of the present invention may include only a forward channel extension.

In any embodiment of the present invention, the last precision hitting zone provided within the channel 21 comprises an opening in the beveled edge on the appropriate parallel side of the base assembly 10 through which the tube assembly 50 can be easily removed from the channel 21.

Figure 4:
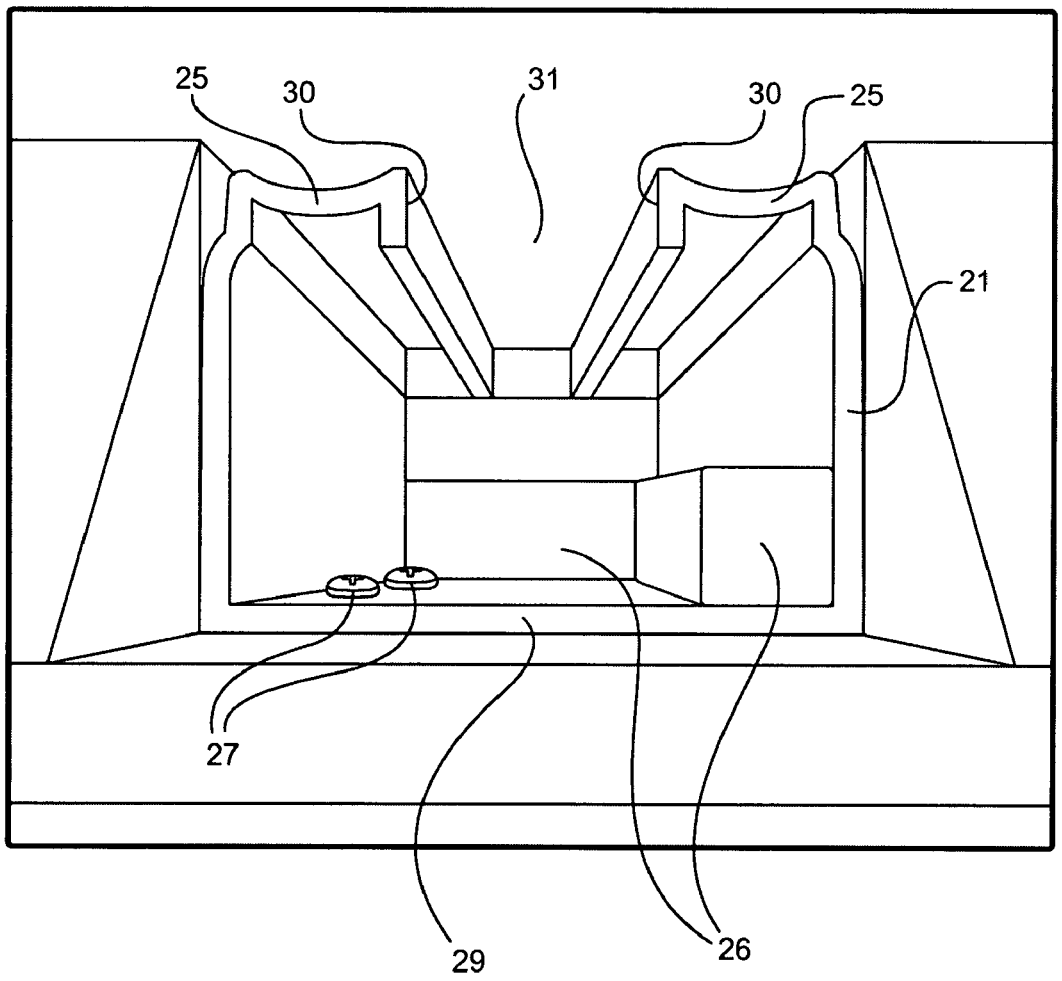
FIG. 4 is a side perspective view of the first channeling system shown in FIG. 1.

Referring now to FIG. 4, additional details of the first channeling system according to the present invention are disclosed. As described previously, the continuous channel 21 of the present invention is formed to receive and removably secure the tube assembly 50 to the base assembly 10. Preferably, the channel 21 is made of a hardened material, such as aluminum or steel, and may be formed by casting or molding. As shown in FIG. 4, in one preferred embodiment, the channel 21 includes a top portion 25 that includes two corresponding flanged edges 30 defining a top opening 31. The top opening 31 allows the tube assembly 50 to be moved along the continuous length of the channel 21. Advantageously, the flanged edges 30 of the channel 21 provide support and stability for the tube assembly 50 upon insertion into either side openings 20, 22 of the base assembly 10.

The top portion 25 of the channel 21, as shown in FIGS. 1-4, is substantially co-planar with the upper surface 23 of the base assembly 10 and the lower portion 29 of the channel 21 is substantially coplanar with the lower surface of the base assembly 10. Preferably, the opening 31 provided at the top portion 25 of the channel 21 is formed having a width less than the width of the portion of channel 21 below the upper flanged edges 30.

As shown in FIG. 4, the continuous channel 21 of the present invention includes an inner-locking guide rail 26 for securing the tube assembly 50 to a selected location along the channel 21, as described below. Preferably, the inner-locking guide rail 26 is formed in either a rectangular or square shape and is adhered to an interior portion of the channel. The guide rail 26 may be made from a material the same as or similar to the material used to form the channel 21. In one preferred embodiment, the guide rail 26 is positioned to extend in a longitudinal direction along a portion of the bottom surface of the channel 21 and a portion of the sidewall of the channel 21 adjacent to the bottom surface of the base assembly 10. Of course, it will be appreciated by one skilled in the art that the inner-locking guide rail 26 of the present invention need not be a separate device but may be integrally formed as part of the channel 21. For example, in one preferred embodiment, the inner-locking guide rail 26 is molded to one side of the channel 21. In another preferred embodiment, the inner-locking guide rail is integrally formed on a sidewall of the channel 21.

In another embodiment, for example, a plurality of inner-locking guide rails are attached to the interior walls of the channel at locations adjacent to the bottom surface of the channel. In yet another preferred embodiment, a plurality of inner-locking guide rails are integrally formed as part of the channel, each of which is positioned on the two sides of an interior wall of the channel at a location adjacent to the bottom surface of the channel.

Preferably, the positioning and dimensioning of the inner-locking guide rail 26 is configured to permit space adjacent to it and the corresponding side wall of the channel (if only one guide rail is attached) or in between the guide rails (if two guide rails are used) for the tube assembly 50 to fit securely within the channel 21 and on the bottom surface 29 of the channel 21.

Figure 5:
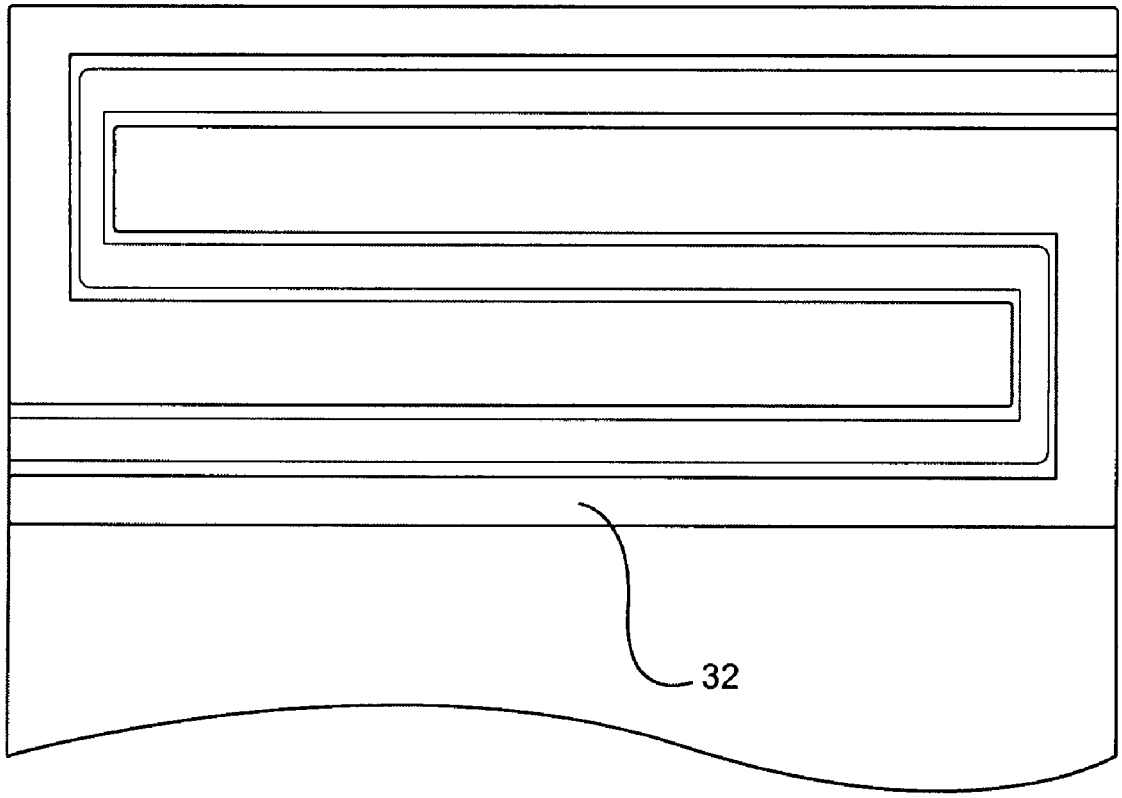
FIG. 5 is a top perspective view of a base assembly including a second channeling system according to the present invention.
Figure 6:
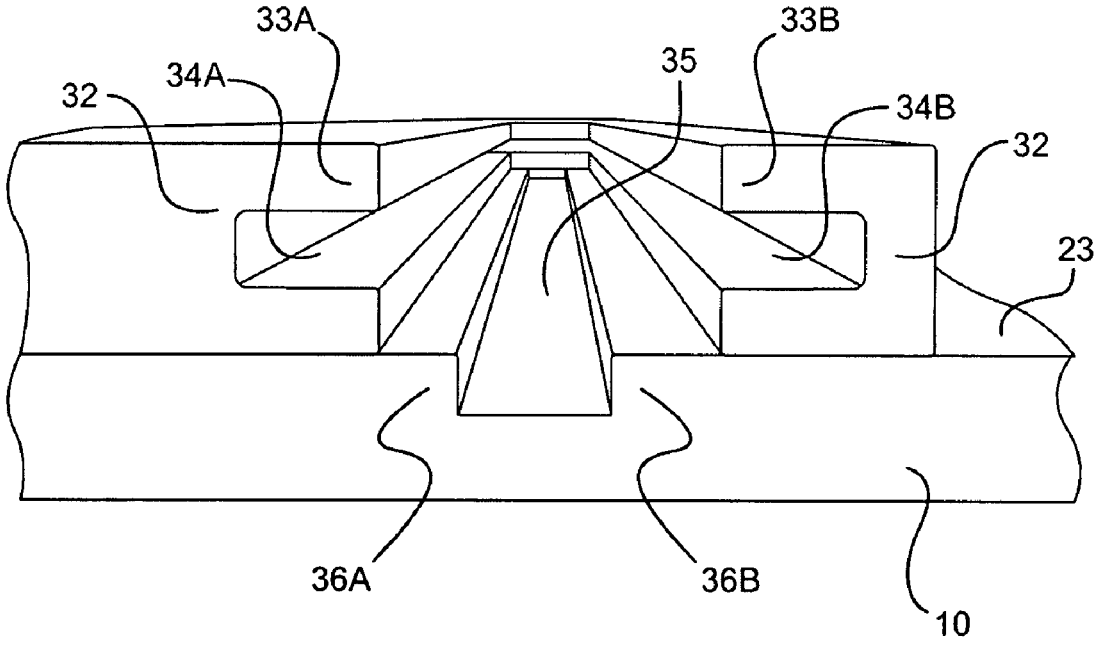
FIG. 6 is a side perspective view of the second channeling system shown in FIG. 5.

Referring now to FIGS. 5 and 6, a second channeling system according to the present invention is disclosed. As shown in FIGS. 5 and 6, the second channeling system includes a continuous channel 32 formed from dual U-shaped devices 33A, 33B located opposite one another and a grooved track 35, having a generally inverted T-shape, in the base assembly 10. In one preferred embodiment, both the dual U-shaped devices 33A, 33B and the grooved track 35 are grooved into the base assembly. In another preferred embodiment, as shown in FIGS. 5 and 6, the dual U-shaped devices 33A, 33B are attached to the top upper surface 23 of the base assembly 10. In yet other preferred embodiments, the dual U-shaped devices 33A, 33B and grooved track 35 are prefabricated as a single device which is then either grooved into the base assembly 10 or attached to the top surface 23 of the base assembly 10.

In one preferred embodiment, as shown in FIGS. 5 and 6, the dual U-shaped devices 33A, 33B provide slots 34A, 34B, respectively, in the channel 32 that are sized to accommodate a slidable device, such as a first slidable device 42C, which forms part of a first slidable member 42 discussed in connection with FIGS. 7 and 8 or a second slidable device 60C, which forms part of a second slidable member 60 discussed in connection with FIGS. 14-16, both of which slidable members are attached to the tube assembly 50. The slots 34A, 34B and the grooved track 35 allow the tube assembly 50 to slide throughout the channel 32 to any desirable position.

In one preferred embodiment, as shown in FIG. 6, the second channeling system preferably includes two inner-locking guide rails 36A, 36B that are used to secure the tube assembly 50 to a desired location along the continuous channel 32. Of course, it will be appreciated by one skilled in the art that the inner-locking guide rails 36A, 36B shown in FIGS. 6 may be separately molded and attached to the base assembly 10 or be formed as an integral part of either the base assembly 10 or channel 32.

In yet another preferred embodiment, the second channeling system may include one or more side-channel extensions and/or forward channel extensions as previously described in connection with FIG. 17.

Figure 9:
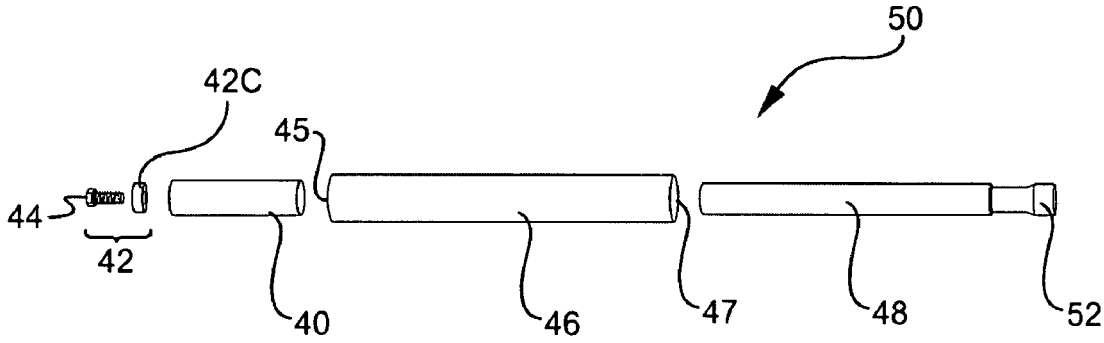
FIG. 9 is an exploded view of the tube assembly according to the present invention.
Figure 10:
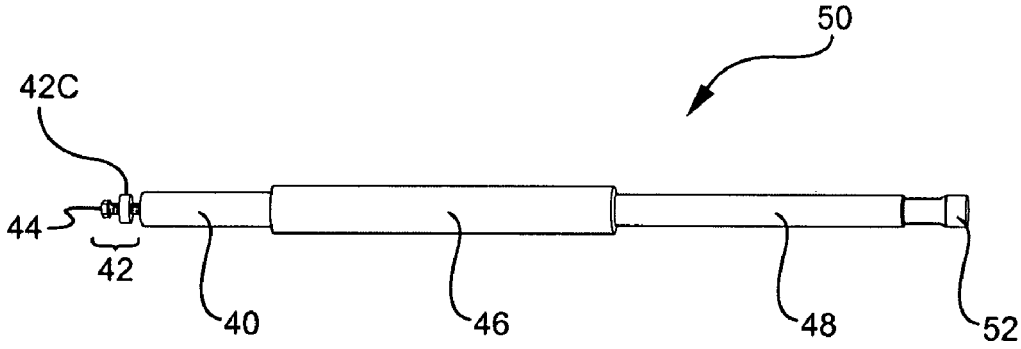
FIG. 10 is a side perspective view of an assembled tube assembly according to the present invention.

Referring now to FIGS. 9 and 10, the tube assembly 50 of the present invention is disclosed. As shown in FIGS. 9 and 10, the tube assembly 50 comprises upper 48 and lower 46 cylindrically shaped members that are telescopically interconnected. Preferably, the upper member 48, referred to as the batter's pole extender, and lower member 46, referred to as the batter's pole, are each constructed of a flexible, resilient material, such as rubber or plastic and are capable of absorbing the centrifugal force generated by a bat striking the tube assembly 50.

In one preferred embodiment, the upper member 48 is constructed such that it is telescopically maneuverable by hand in a vertical direction relative to the base assembly 10 and preferably forms a frictional fit through a top opening 47 of the lower member 46. Preferably, the top end of the upper member 48 is formed in a concave shape so as to form a cradle 52 on which the baseball or softball can be securely placed in position to be struck by a bat. As will be appreciated by one skilled in the art, allowing the upper member 48 to be telescopically maneuverable by a one-hand motion allows a user of the device to obtain a desired height adjustment of the tube assembly 50 from which the ball may be struck.

The lower member 46 of the tube assembly 50 permits insertion at its open bottom end 45 a cylinder-type shaped impact absorbing element 40 capable of receiving the centrifugal force of the tube 50 upon being struck by a bat. Preferably, the impact absorbing element 40 is formed from a hardened material, such as aluminum or steel. In one preferred embodiment, for example, the absorbing element 40 is positioned at the bottom end 45 of the lower member 46 and allows the tube assembly 50 to appropriately bend and flex towards the base assembly 10 upon impact by the bat without unwarrantedly tipping over. The length of the absorbing element 40 is adequate to absorb the impact of the bat on the overall tube assembly 50 (the batter's pole with pole extender) but is preferably not of such a length whereby errant striking of the overall tube assembly 50 with the bat results in the bat striking that part of the lower member 46 containing the impact absorbing element component 40.

Figure 7:
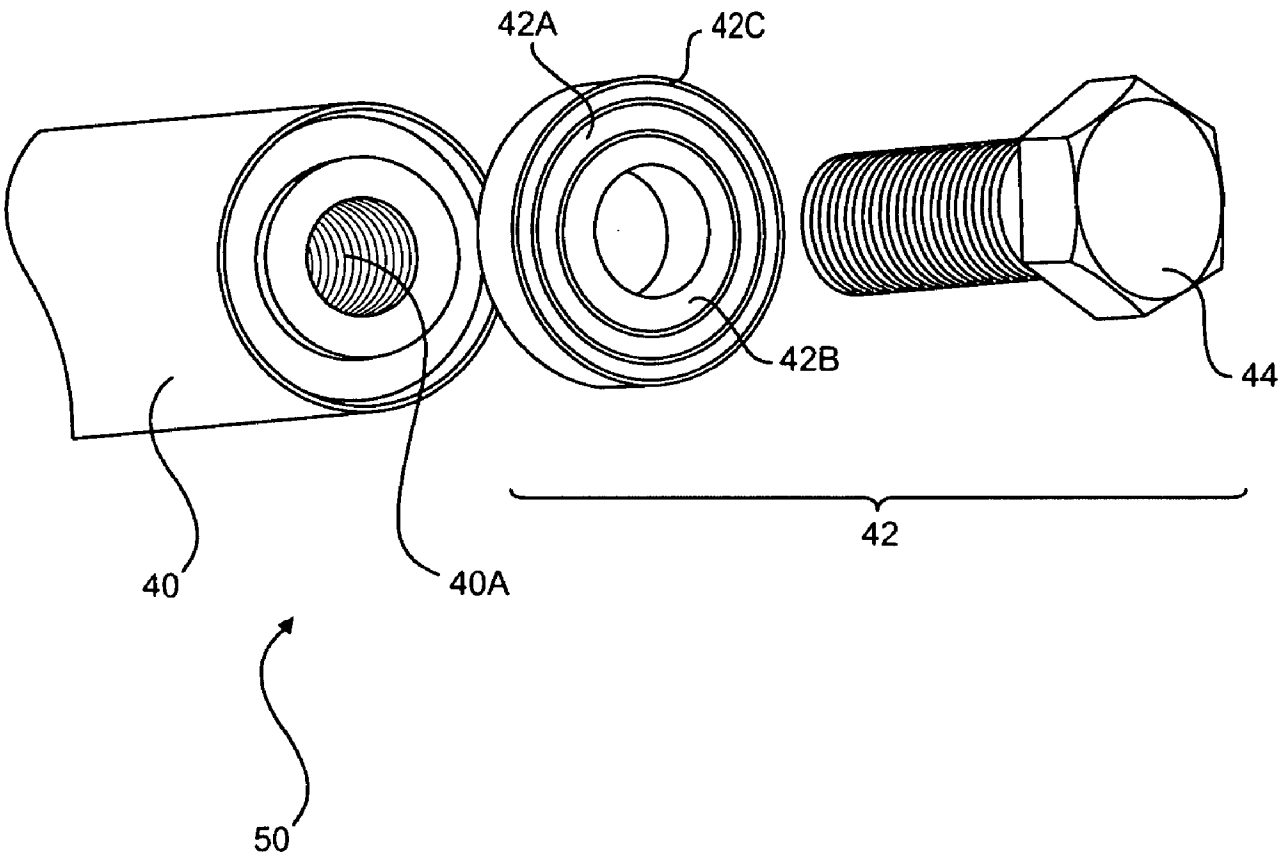
FIG. 7 is an exploded view of part of the lower portion of a tube assembly including a threaded bolt, a first slidable device and a cylinder.
Figure 8:
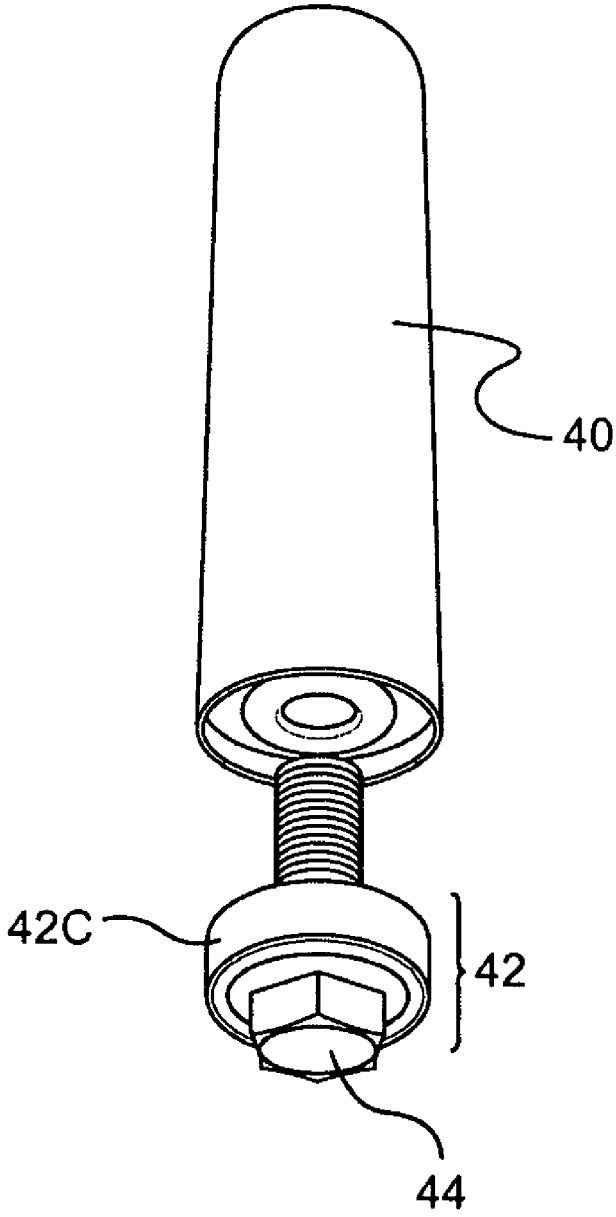
FIG. 8 is a bottom perspective view of part of the lower portion of the tube assembly shown in FIG. 7 with the threaded bolt attached to the ball bearing.

Referring now to FIGS. 7 and 8, a lower portion of the tube assembly 50 according to the present invention is disclosed. As shown in FIGS. 7 and 8, in one preferred embodiment, the cylindrical impact absorbing element 40 is constructed with an inner threaded hole 40A to receive and engage a threaded rod 44 with a multi-sided head, such as a hexagon bolt. Preferably, a slidable device 42C comprising a number of hard balls running in grooves in the surfaces of two concentric rings 42A, 42B, one of which is mounted on a rotating or oscillating shape, such as a rolling bearing, is then precisely fitted onto a shank of the threaded rod 44 to form a first slidable member 42 of the present invention. Of course, it will be appreciated by one skilled in the art that the slidable device 42C of the present invention is not limited to a rotating or oscillating shape and may be otherwise sized and shaped so as to be selectively and moveably received in the channel 21 of the first channeling system.

Upon insertion of the assembled impact absorbing element 40 with slidable member 42 into the lower member 46, the tube assembly 50 is now assembled for insertion into the base assembly 10 as described below. Of course, it will be appreciated by one skilled in the art that it is the entire tube assembly 50, that is, the batter's pole component 46 with the slidable member 42 attached along with the batter's pole extender component 48 telescopically fitted to the batter's pole 46, that may be inserted into the channel 21 in the upper surface 23 of the base assembly 10.

In operation, the tube assembly 50 of the present invention can be slidably moved across the horizontal plane of either the first or second channeling system and be positioned at any desired location selected by the user. Examples of the various positions the tube assembly 50 may be positioned at are shown in FIGS. 13A-13G. Of course, it will be appreciated by one skilled in the art that the present invention is not limited to the positions shown in FIGS. 13A-13G and that the tube assembly 50 may be positioned in other desirable locations by the user.

For example, the user of the present invention may slide the tube assembly 50 while in an open position with one hand through either the first or second channeling system described herein and then rotate the tube assembly 50 in either a clockwise or counterclockwise direction relative to the base 10 to a closed position. Preferably, rotation to the closed position causes the multi-sided head of the threaded rod 44 to engage either of the inner-locking guide rails disclosed herein and thereby locks the tube assembly 50 into a desired position. For example, in one preferred embodiment utilizing the first channeling system, rotating the tube assembly 50 in a clockwise position results in the multi-sided head of the threaded rod 44 making desired contact with one or more inner-locking guiderails 26 thereby securing the tube assembly 50 in a desired location along the channel 21.

In some preferred embodiments, rotation of the tube assembly 50 may result in the first slidable device 42C moving in a vertical direction relative to the base assembly 10 contacting the bottom end of the flanged edges 30 of the channel 21 due to the slidable member 42 being threadingly engaged to the cylinder 40 of the tube assembly 50. As a result, the bottom end of lower member 46, with impact absorbing element 40 inserted therein, of tube assembly 50 may be press-fit against a top portion 25 of channel 21 and further secure the tube assembly 50 at a desirable location along the channel 21.

Figure 11:
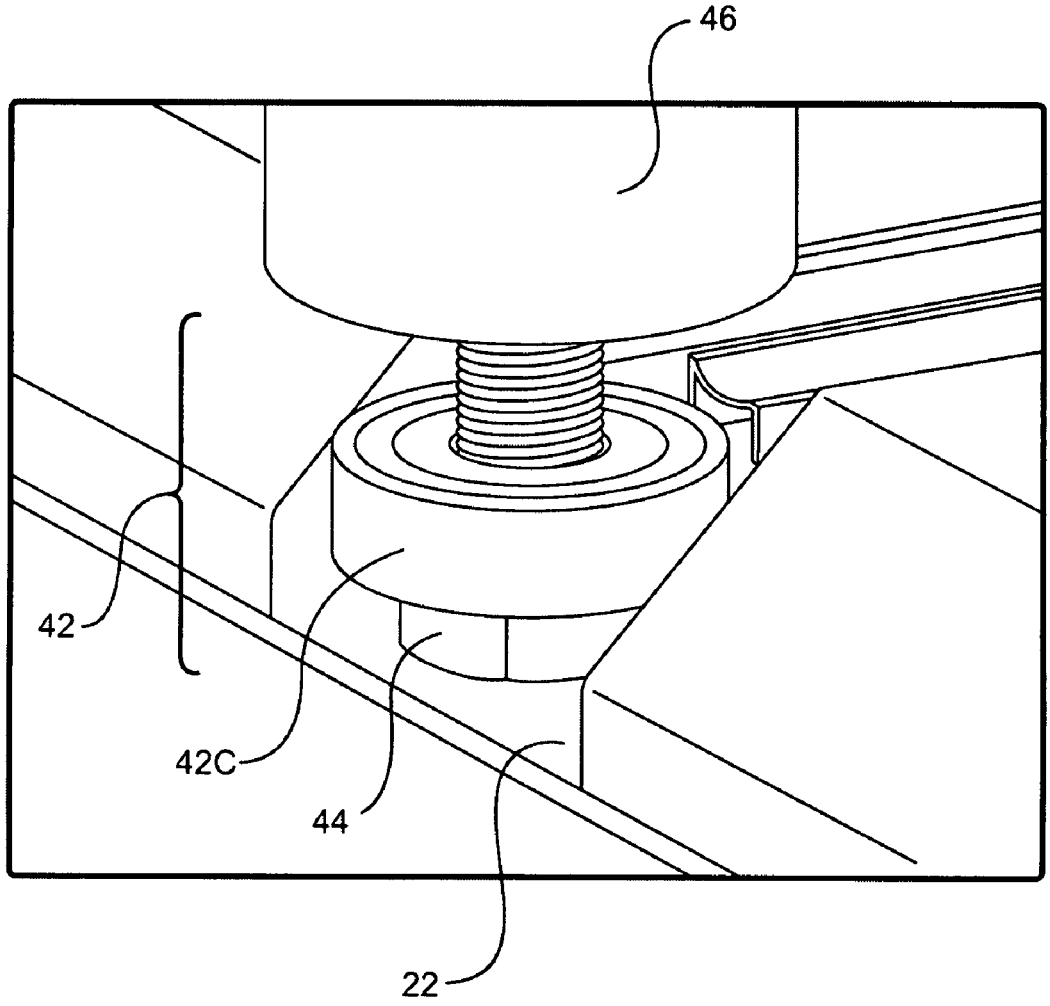
FIG. 11 is a side perspective view of the tube assembly entering the first channeling system of FIG. 1.
Figure 12:
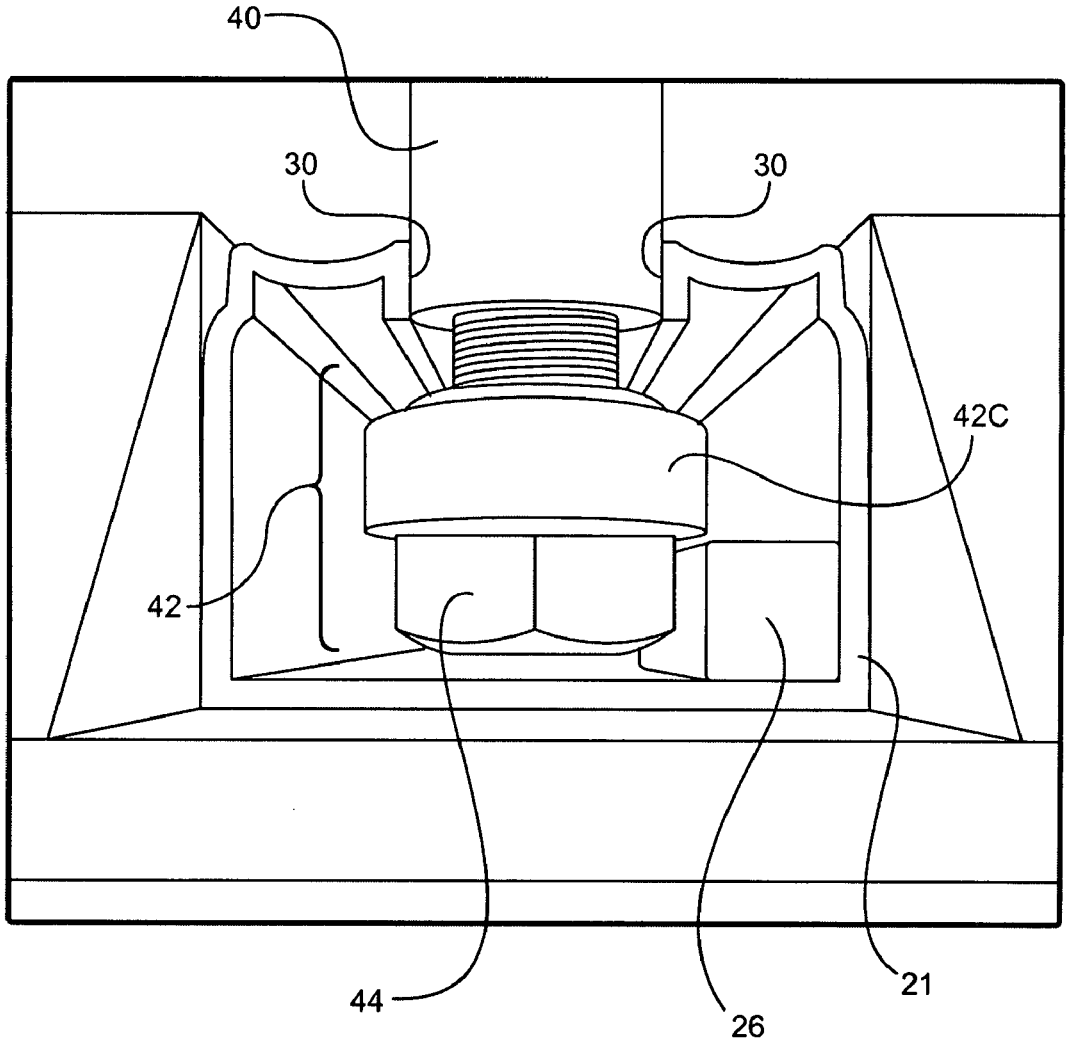
FIG. 12 is a side perspective view of the tube assembly secured to the channel and to an inner guide rail of the first channeling system of FIG. 1.
Figure 13A:
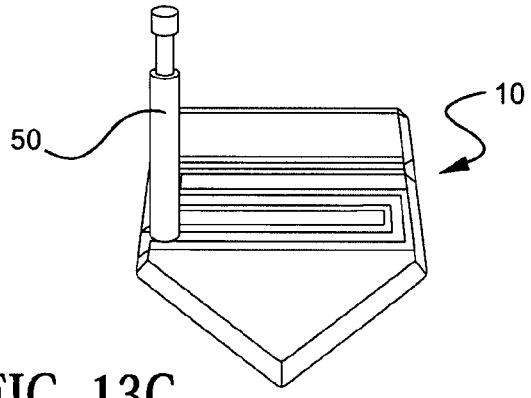
FIGS. 13A-13G show front perspective views of the tube assembly secured to alternative positions of the first channeling assembly shown in FIG. 1, respectively.
Figure 13B:
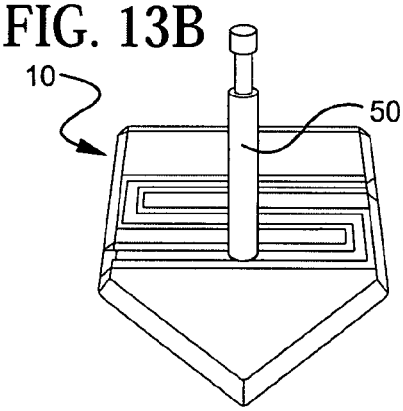
Figure 13C:
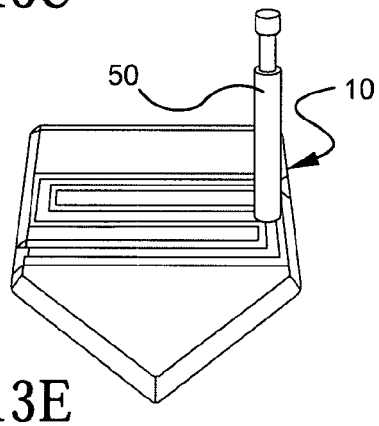
Figure 13D:
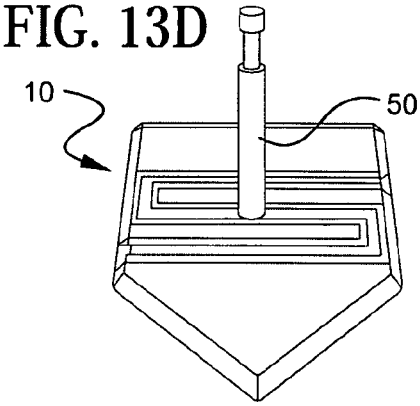
Figure 13E:
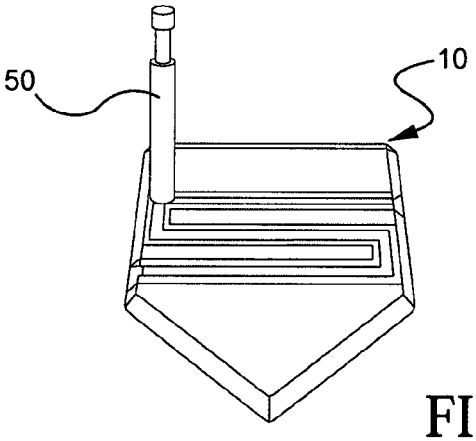
Figure 13F:
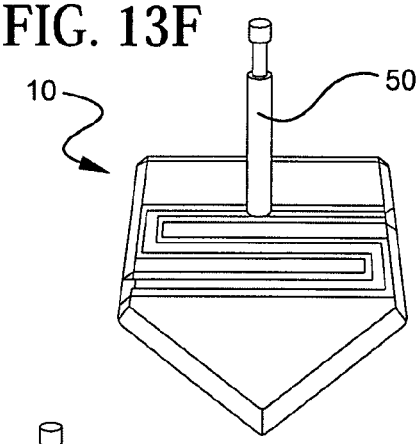
Figure 13G:
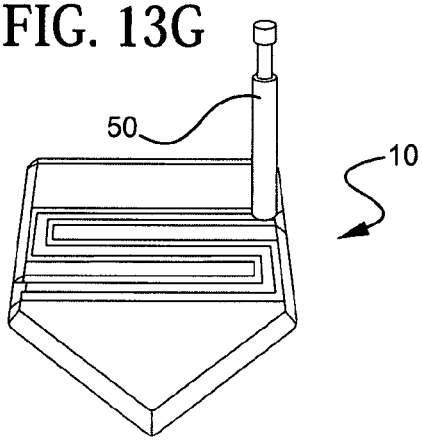

In one preferred embodiment, as shown in FIGS. 11 and 12, the guide rail 26 of the present invention allows the top side of the first slidable device 42C to slidably move through the continuous grooved channel 21 along the underside of the flanges 30 that define the opening 31 at the upper section of the channel 21. An underside of the first slidable device 42C is also permitted to slidably move through the channel 21 on a top side of the inner-locking guide rail 26. Further, the multi-sided head of the threaded rod 44 is permitted to slidably move along the lower portion 29 of channel 21.

As a result of the above interactions, the tube assembly 50 can be slidably moved through the continuous grooved channel 21 to any desired location over the base assembly 10 and be locked into position against the inner-locking guide rail 26. In one preferred embodiment, for example, the tube assembly 50 may be rotated in a clockwise direction thereby securing the first slidable device 42C in the channel 21. Preferably, upon rotation of the tube assembly 50, the multi-sided head of the threaded rod 44 engages one or more side walls of the inner guide rail[s]. Preferably, the interaction of the threaded rod 44 with the inner guide rail 26 further stabilizes the tube assembly 50 and the base assembly 10. In addition, both the inner guide rail 26 and the channel 21 create centripetal barriers capable of withstanding the centrifugal force created by a bat striking the tube assembly 50.

Several advantages stem from creating these centripetal barriers. For example, upon striking the tube assembly 50 with a bat, the centripetal barriers may diminish the probability of the tube assembly 50 being displaced from its secured position in the channel 21 or tipping over during normal operation of the device. Furthermore, by creating centripetal barriers, the base assembly 10 may be more stabilized and not unwarrantedly move during normal operation of the practice tee.

Figure 14:
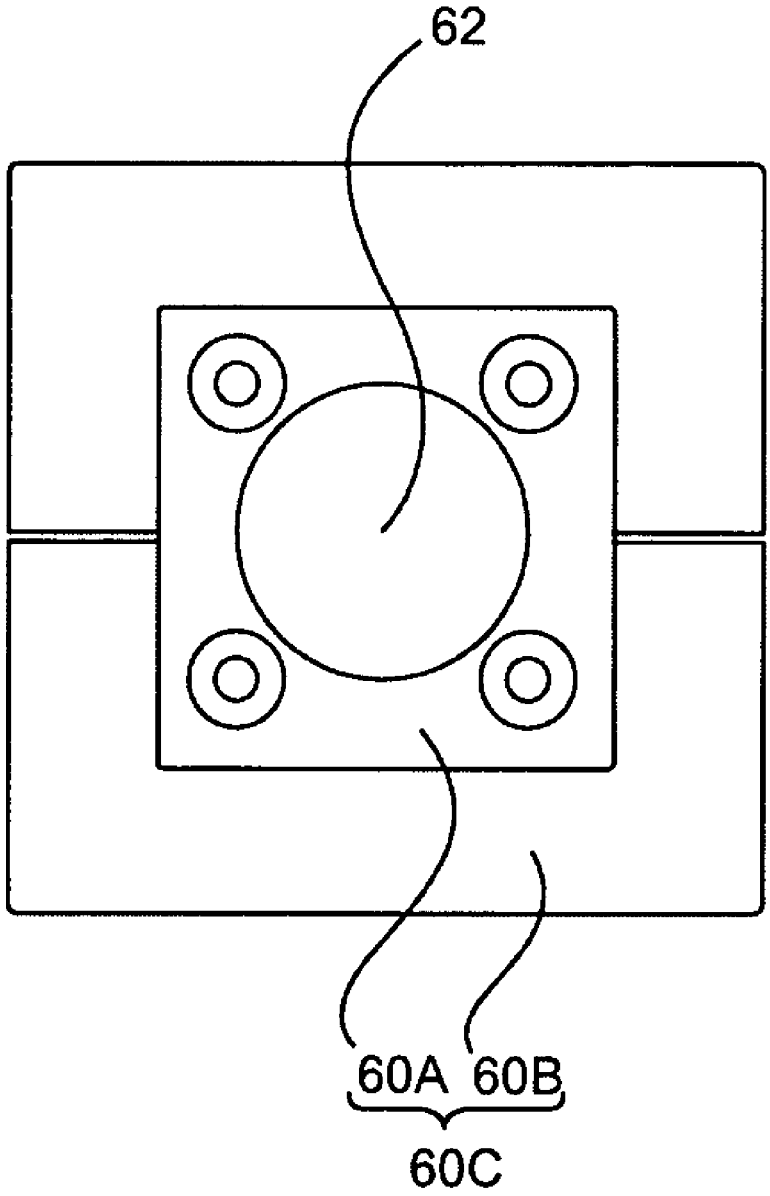
FIG. 14 is a top perspective view of a second slidable device used with the second channeling system shown in FIG. 6 according to the present invention.

Referring now to FIG. 14, a top perspective view of the second slidable device 60C for use with the second channeling system of the present invention is disclosed. As shown in FIG. 14, in one preferred embodiment, the second slidable device 60C is formed having a generally square or rectangular shape and is made from a hardened material such as titanium, aluminum or steel. Preferably, the slidable device 60C is fabricated in a stamped, molded, or dye-cast manner.

Figure 15:
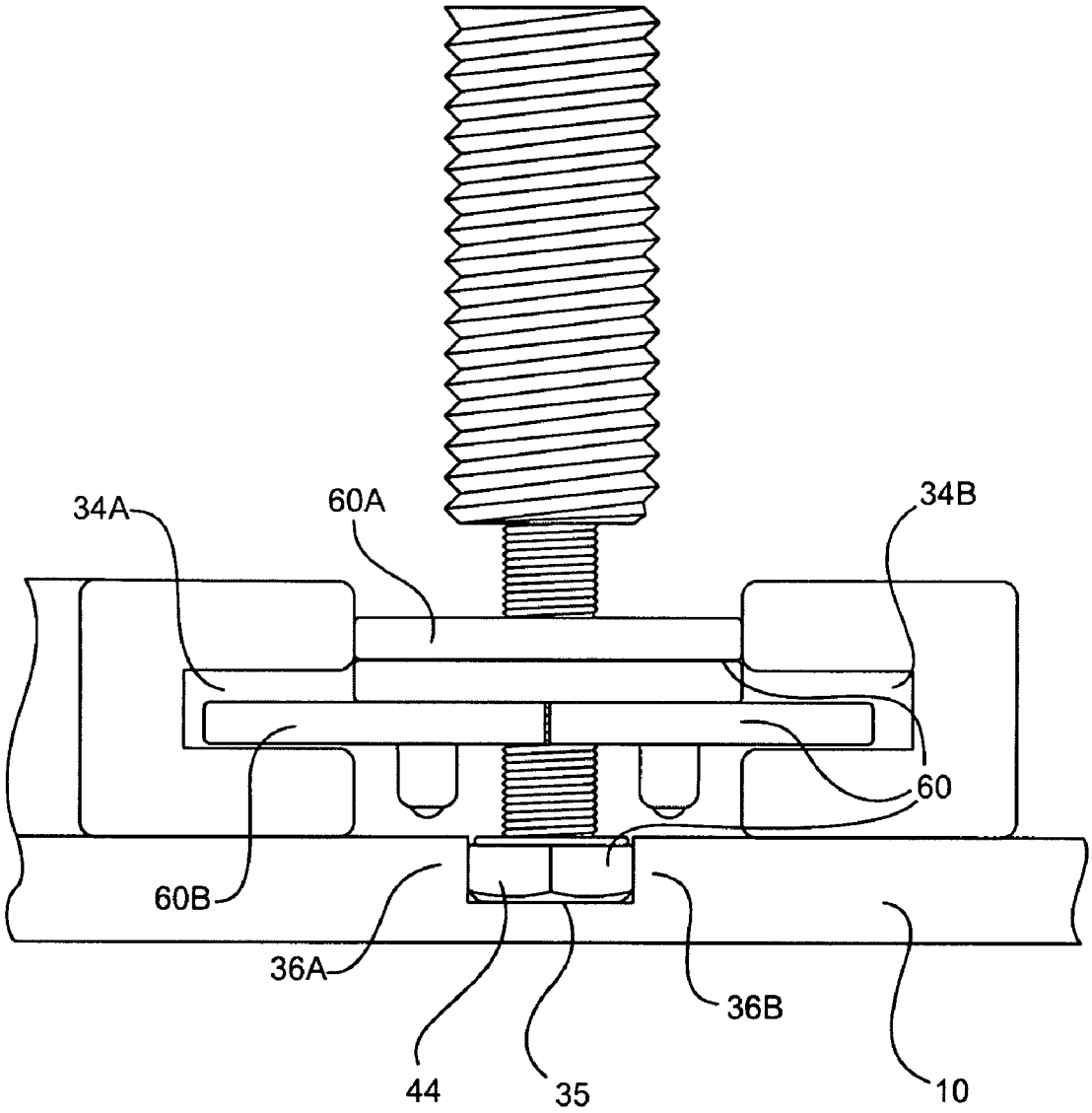
FIG. 15 is a side perspective view of the second slidable member entering the second channeling system shown in FIG. 6 according to the present invention.

In one preferred embodiment, as shown in FIGS. 14-15 the slidable device 60C includes an upper portion 60A and a lower portion 60B having a slotted opening 62 for receiving the threaded rod 44, which when so engaged forms a second slidable member 60 of the present invention. In one preferred embodiment, the upper portion 60A is formed having a diameter less than the lower portion 60B and is adapted to slide along the top channel edges of the second channeling system. Of course, it will be appreciated by one skilled in the art that the slidable device 60C may be otherwise sized and shaped so as to be selectively and moveably received in the channel 32 of the second channeling system.

Figure 16:
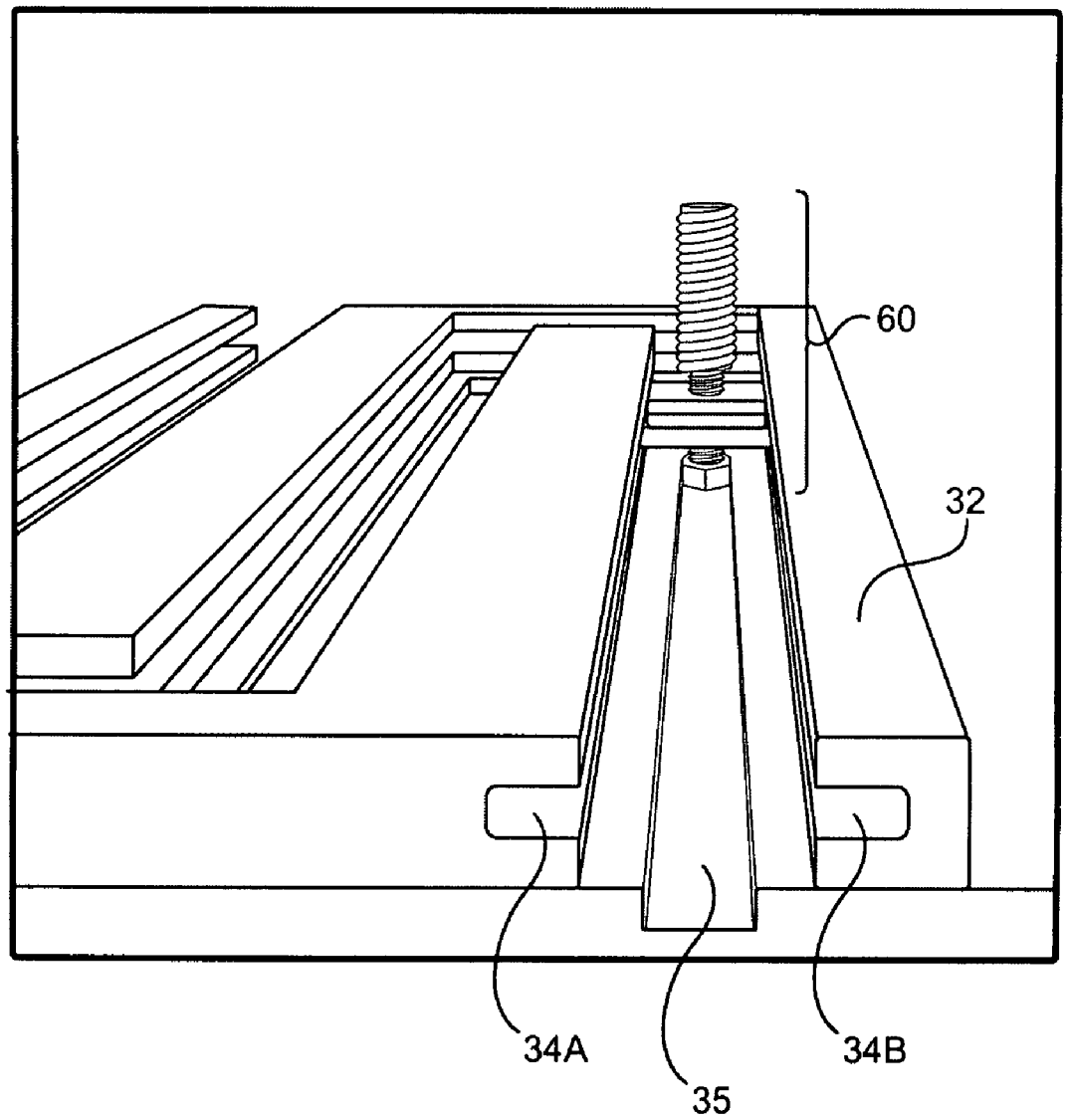
FIG. 16 is a side perspective view of the second slidable member positioned on a track of the second channeling system shown in FIG. 6.

Referring now to FIGS. 15-16, use of the second slidable member 60 with the second channeling system of the present invention is described. As shown in FIGS. 15-16, in one preferred embodiment, the multi-sided head of the threaded rod 44 is positioned in the grooved track 35 of the base assembly 10. The lower portion 60B of the slidable device 60C is then positioned in slots 34A, 34B provided by the dual U-shaped devices 33A, 33B. The slots 34A, 34B provide support for the slidable device 60C and the slidable member 60, and may be formed to accommodate multiple types of slidable devices and slidable members (e.g., the first and second slidable devices and members discussed previously).

In operation, the tube assembly 50 incorporating the second slidable member 60 can be slidably moved across the horizontal plane of the second channeling system and be positioned at any desired location selected by the user. Similar to the first slidable member 42 described previously, the user may slide the tube assembly 50 incorporating the second slidable member 60 while in an open position with one hand through the channel 32 and then rotate the tube assembly 50 in either a clockwise or counterclockwise direction to a closed position, causing the multi-sided head of the threaded rod 44 to engage one or more inner-locking guide rails 36A, 36B and thereby lock the tube assembly 50 into a desired position. In one preferred embodiment, rotating the tube assembly 50 in a clockwise direction results in the multi-sided head of threaded rod 44 making desired contact with one or more inner-locking guide rails 36A, 36B, and thereby securing the tube assembly 50 in a desired location along the channel 32. In some preferred embodiments, rotation of the tube assembly 50 also results in the lower portion 60B of the second slidable device 60C moving in a vertical direction with respect to the base assembly 10 making desired contact with the top portion of the slot 34A, 34B of channel 32 due to the slidable member 60 being threadingly engaged to impact absorbing element 40 of tube assembly 50. As a result, the bottom end of lower member 46, with impact absorbing element 40 inserted therein, of tube assembly 50 may be press-fit against a top portion of each U-shaped device 33A, 33B and further secure the tube assembly 50 at a desirable location along the channel 32.

The invention having been thus described, it will be apparent to those skilled in the art that the same may be varied in many ways without departing from the spirit of the invention. Any and all such modifications as would be obvious to those skilled in the art are intended to be covered within the scope of the following claims. Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A batting practice tee comprising:

a base assembly including a continuous uninterrupted channel fixedly mounted to said base assembly, said channel being defined by first and second sidewalls extending generally downwardly, a bottom surface generally orthogonal to the sidewalls, and a top portion having an opening, said channel including an inner-locking guide rail fixedly disposed within said channel along said bottom surface of said channel and said first sidewall between a first termination point and a second termination point of said channel, said inner-locking guide rail protruding into a space defined by said channel so that a width of a lower space of said channel is smaller than a width of an upper space of said channel; said inner-locking guide rail forming a generally rectangular profile within said channel, a height of said inner-locking guide rail being a portion of a height of said first sidewall and a width of said inner-locking guide rail being a portion of a width of said bottom surface; and a tube assembly for holding a ball, said tube assembly removably coupled to said channel and being rotatable between an open position and a closed position, said tube assembly including a slidable device disposed about a rod of said tube assembly, a head of said rod fitting within the lower space of said channel and said slidable device fitting within the upper space of said channel so that a portion said slidable device is positioned above said-inner-locking guide rail, said slidable device being wider than the lower space of said channel, wherein, in said open position, said tube assembly is removable from said channel and movable throughout said channel, and wherein, in said closed position, said tube assembly engages said inner-locking guide rail to secure said tube assembly to a location along said channel, said tube assembly holding said ball above said location.

2. The batting practice tee of claim 1, wherein said continuous channel is formed in a generally inverted T-shape and grooved into said base assembly.

3. The batting practice tee of claim 2, further comprising at least one side channel extension for attachment to said continuous channel.

4. The batting practice tee of claim 2, further comprising at least one forward channel extension for attachment to said continuous channel above a leading edge of said base assembly.

5. The batting practice tee of claim 1, wherein said continuous channel is mounted to a top surface of said base assembly.

6. The batting practice tee of claim 5, further comprising at least one side channel extension for attachment to said continuous channel.

7. The batting practice tee of claim 5, further comprising at least one forward channel extension for attachment to said continuous channel above a leading edge of said base assembly.

8. The batting practice tee of claim 1, wherein said continuous channel comprises dual U-shaped devices and a grooved track having a generally inverted T-shape, said U-shaped devices and said T-shaped track grooved into said base assembly.

9. The batting practice tee of claim 8, further comprising at least one side channel extension for attachment to said continuous channel.

10. The batting practice tee of claim 8, further comprising at least one forward channel extension for attachment to said continuous channel above a leading edge of said base assembly.

11. The batting practice tee of claim 1, wherein said continuous channel comprises dual U-shaped devices and a grooved track having a generally inverted T-shape, said U-shaped devices and said T-shaped track mounted on a top surface of said base assembly.

12. The batting practice tee of claim 11, further comprising at least one side channel extension for attachment to said continuous channel.

13. The batting practice tee of claim 11, further comprising at least one forward channel extension for attachment to said continuous channel above a leading edge of said base assembly.

14. The batting practice tee of claim 1, wherein said continuous channel is formed from a single channel having a U-shape and inverted T-shape, said single channel grooved into said base assembly.

15. The batting practice tee of claim 14, further comprising at least one side channel extension for attachment to said continuous channel.

16. The batting practice tee of claim 14, further comprising at least one forward channel extension for attachment to said continuous channel above a leading edge of said base assembly.

17. The batting practice tee of claim 1, wherein said continuous channel is formed from a single channel having a U-shape and inverted T-shape, said single channel mounted on a top surface of said base assembly.

18. The batting practice tee of claim 17, further comprising at least one side channel extension for attachment to said continuous channel.

19. The batting practice tee of claim 17, further comprising at least one forward channel extension for attachment to said continuous channel above a leading edge of said base assembly.

20. The batting practice tee of claim 1, further comprising a handle.

21. The batting practice tee of claim 1, wherein said tube assembly comprises a slidable member for moving said tube assembly through said channel, said slidable member including a slidable device and a threaded rod.

22. The batting practice tee of claim 1, wherein said tube assembly comprises a slidable member for moving said tube assembly through said channel, said slidable member including an upper portion and a lower portion having a slotted opening for receiving a threaded rod.

23. The batting practice tee of claim 1, wherein said continuous channel provides stability to at least one of said tube assembly and said base assembly.

24. The batting practice tee of claim 1, wherein said inner-locking guide rail provides a surface for guided movement of said tube assembly throughout said continuous channel.

25. The batting practice tee of claim 24, wherein said surface is a top surface.

26. The batting practice tee of claim 24, wherein said inner-locking guide rail engages and secures said tube assembly to at least one location along said channel.

27. The batting practice tee of claim 1, wherein said inner-locking guide rail provides stability to at least one of said tube assembly and said base assembly.

28. The batting practice tee of claim 27, wherein said inner-locking guide rail provides a centripetal force barrier to absorb a centrifugal force generated by a bat striking said tube assembly.

29. The batting practice tee of claim 27, wherein said continuous channel provides a centripetal force barrier to absorb a centrifugal force generated by a bat striking said tube assembly.

30. The batting practice tee of claim 1, wherein said tube assembly includes a threaded rod and a slidable device fitted about the shank of said threaded rod between the head of said threaded rod and an impact absorbing element of said tube assembly that threadingly engages said threaded rod, the head of said threaded rod being configured to fit in a space adjacent to said inner-locking guide rail and one of a side wall of said continuous channel or a second inner-locking guide rail, said slidable device being positioned above said inner-locking guide rail when said tube assembly is moveably coupled to said base assembly.

31. The batting practice tee of claim 1, wherein said channel is a single undivided continuous channel configured to facilitate movement of said tube assembly to each available batting position of said batting practice tee without removal of said tube assembly from said channel.

* * * * *